US010442447B2

(12) United States Patent
Timan et al.

(10) Patent No.: US 10,442,447 B2
(45) Date of Patent: Oct. 15, 2019

(54) SEATING ARRANGEMENT FOR A FRONT END OF A MONORAIL CAR

(71) Applicant: BOMBARDIER TRANSPORTATION GMBH, Berlin (DE)

(72) Inventors: Peter Timan, Sydenham (CA); Scott Finlayson, Belleville (CA)

(73) Assignee: BOMBARDIER TRANSPORTATION GMBH, Berlin (CA)

( * ) Notice: Subject to any disclaimer, the term of this patent is extended or adjusted under 35 U.S.C. 154(b) by 299 days.

(21) Appl. No.: 15/461,828

(22) Filed: Mar. 17, 2017

(65) Prior Publication Data

US 2018/0265100 A1 Sep. 20, 2018

(51) Int. Cl.

| | |
|---|---|
| ***B61D 33/00*** | (2006.01) |
| ***B61B 13/04*** | (2006.01) |
| ***B61D 1/04*** | (2006.01) |

(52) U.S. Cl.

CPC ..... *B61D 33/0064* (2013.01); *B61B 13/04* (2013.01); *B61D 1/04* (2013.01)

(58) Field of Classification Search

CPC ..... B61D 31/00; B61D 33/00; B61D 33/0064
USPC ..... 105/344
See application file for complete search history.

(56) References Cited

U.S. PATENT DOCUMENTS

| | | | | | |
|---|---|---|---|---|---|
| 2,285,933 | A * | 6/1942 | Ledwinka | B61D 1/08 | 105/340 |
| 2,811,932 | A * | 11/1957 | Clary | B61D 1/06 | 105/340 |
| 4,184,434 | A * | 1/1980 | Chapin | B61C 17/04 | 105/340 |
| 5,063,859 | A * | 11/1991 | Rader | B61D 1/06 | 105/340 |
| 7,178,466 | B2 * | 2/2007 | Raoul | B61D 1/06 | 105/329.1 |
| D680,905 | S | 4/2013 | Timan | | |
| 2007/0261591 | A1 * | 11/2007 | Bravo | B61C 17/04 | 105/392.5 |
| 2009/0255437 | A1 * | 10/2009 | Hachet | B61D 1/00 | 105/344 |
| 2018/0265100 | A1 * | 9/2018 | Timan | B61D 33/0064 | |

* cited by examiner

*Primary Examiner* — Jason C Smith
(74) *Attorney, Agent, or Firm* — Benoit & Cote, Inc.; Ibrahim Tamer

(57) ABSTRACT

A head monorail car having a front end and a rear end comprises a body, a front load wheel proximate the front end, a rear load wheel proximate the rear end and a seat installed in a passenger area. The front load wheel and the rear load wheel are laterally centered in the body and at least partially protrude through the floor in the passenger area. The first seat is longitudinally installed at least partially between the front end of the monorail car and a spinning axis of the front wheel.

8 Claims, 4 Drawing Sheets

SEATING ARRANGEMENT FOR A FRONT END OF A MONORAIL CAR

FIELD OF THE INVENTION

The present invention generally relates to the field of monorails. More specifically, the invention relates to a head monorail car having a novel seating arrangement at its front end.

BACKGROUND OF THE INVENTION

Once considered only worthy of being an attraction in an amusement park, monorails have recently gained a lot of credibility as legitimate means of urban transportation. Indeed, monorails now compete in terms of hourly passenger capacity with other types of transportation such as small capacity metros. Hourly passenger capacity define the capacity of a vehicle to move people. Increasing the hourly capacity of a vehicle therefore means that the same vehicle moves more people at once, increasing profitability for the vehicle operator.

Monorails are often perceived as more luxurious, more appealing means of mass transit than metros. However, this perception on its own is often not sufficient to convince a transit authority of opting for that means of transportation. Increasing the passenger capacity of monorails therefore further increases the desirability of such vehicles. Particularly for monorails, increasing the seating capacity is important as it meets the passengers' expectations of travelling comfortably while meeting the transit authority's objective of moving more travelers at once with its equipment.

SUMMARY OF THE INVENTION

It is an object of the present invention to provide a front end seating arrangement for a head monorail car that overcomes or mitigates one or more disadvantages of known seating arrangements, or at least provides a useful alternative.

The invention provides the advantages of permitting more passengers to sit comfortably in a passenger area of a head monorail car.

The invention also provides the advantage of allowing some passengers to sit facing forward and to enjoy a rare view through a front windshield of the head monorail car.

In accordance with an embodiment of the present invention, there is provided a head monorail car having a front end and a read end. The monorail car comprises a body, a front load wheel, a rear load wheel and a seat. The body has a shell and a floor defining a passenger area there in between. The front load wheel is installed proximate the front end and laterally centered with the body. The front load wheel, which has a spinning axis, at least partially protrudes through the floor. The rear load wheel is installed proximate the rear end and is laterally centered with the body. The first seat is installed within the passenger area facing the front end, being positioned longitudinally at least partially between the front end and the spinning axis of the front load wheel.

Advantageously, the monorail car may further comprise a front wheel cover covering the front load wheel. The first seat is then installed at least partially above the wheel cover.

Preferably, a second seat may be installed adjacent the first seat, making for a first row of seats. Room permitting, a third seat may also be installed adjacent the second seat.

Optionally, a second row of seats may be installed back to the first row of seats and facing the rear end. This second row of seats may be installed at least partially above the wheel cover, although typically at a lower level than the first row of seats.

Optionally, the monorail car may be equipped with an upper floor portion extending horizontally between the front end and the first row of seats. The upper floor portion is located at a higher level than that of a lower floor portion of the floor. The first row of seats must then be installed higher than the second row of seats with respect to the lower floor portion.

Conveniently, a passageway may be provided beside the wheel cover, allowing a passenger to reach the upper floor portion from the lower floor portion.

Optionally, the first seat may be installed substantially, or even completely, between the front end of the monorail car and the spinning axis of the front load wheel.

Typically, the monorail car is provided with a windshield at its front end. The windshield may be inclined at an angle of more than 20 degrees from vertical, at more than 40 degrees from vertical, at more than 45 degrees from vertical, or even at more than 50 degrees from vertical.

BRIEF DESCRIPTION OF DRAWINGS

These and other features of the present invention will become more apparent from the following description in which reference is made to the appended drawings wherein.

DETAILED DESCRIPTION OF THE INVENTION

The present invention relates to a monorail car having additional passenger seats installed in a front portion of a passenger area.

Figure 1:
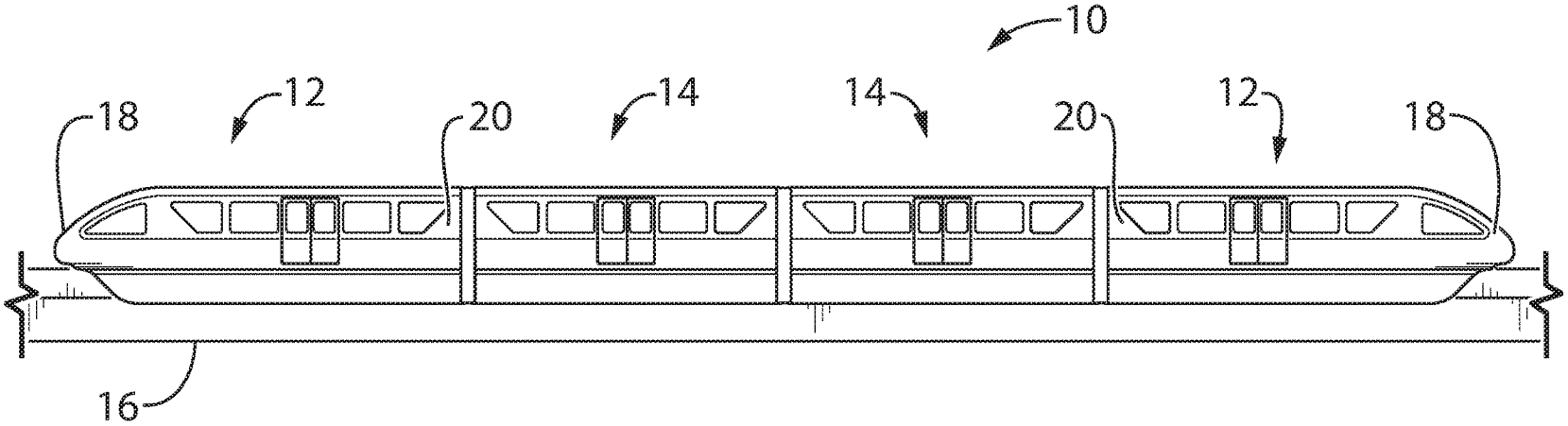
FIG. 1 is a side view of a monorail travelling on a monorail beam in accordance with an embodiment of the present invention.

FIG. 1 is now referred to. A monorail 10, made of two head monorail cars 12 located at each extremity and of two intermediate monorail cars 14 in between, is shown traveling on a beam 16. Each head monorail car 12 has a front end 18 and a rear end 20. Note that a train consist may be made of either no intermediate monorail cars 14 (two head monorail cars 12 are connected back-to-back), or any other number of intermediate monorail cars 14. Typically, between 1 and 6 intermediate monorail cars 14 are used in a monorail consist.

Figure 2:
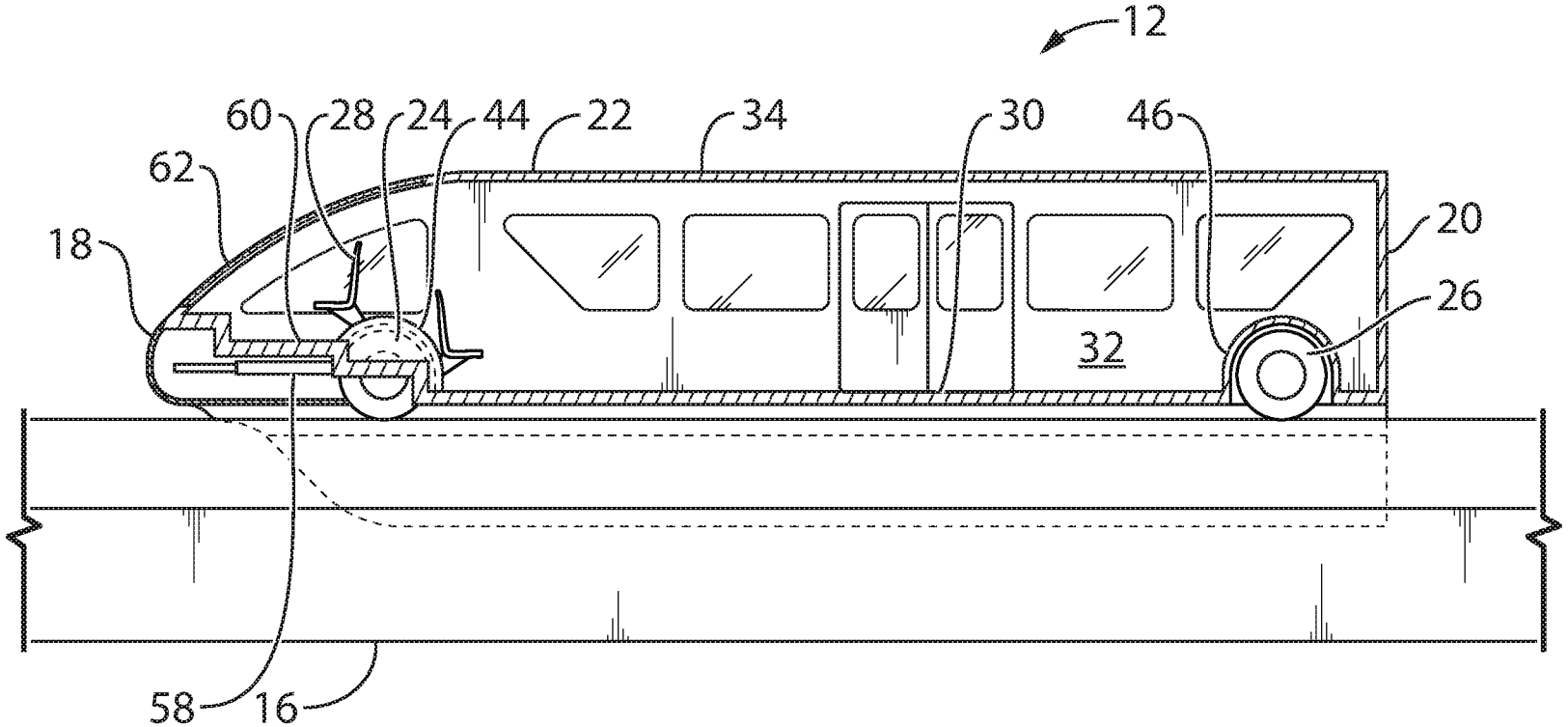
FIG. 2 is a cross-sectional side view of a head monorail car of the monorail of FIG. 1.
Figure 3:
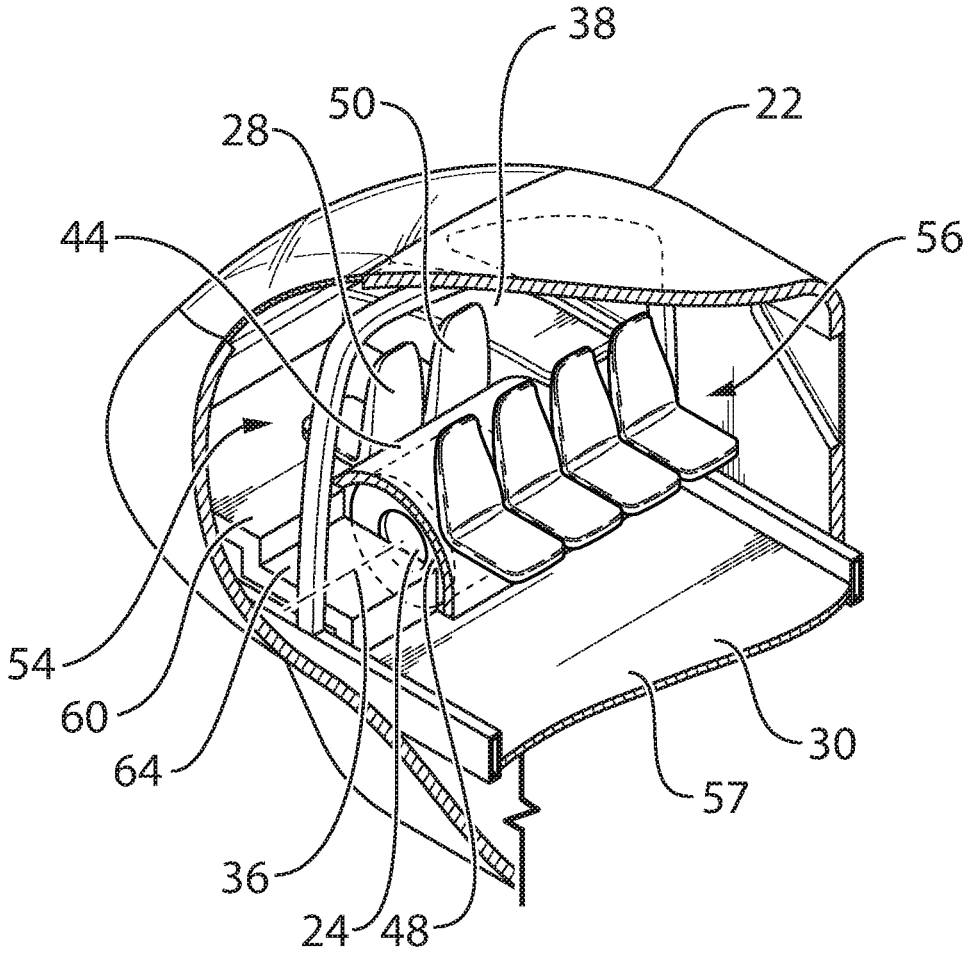
FIG. 3 is a partial cut-away isometric view of the head monorail car of FIG. 2.

FIG. 2 is now concurrently referred to. The head monorail car 12 comprises a body 22, a front load wheel 24 proximate the front end 18, a rear load wheel 26 proximate the rear end 20 and a first seat 28. Both the front and the rear load wheels 24, 26 partially protrude through the floor 30, allowing to position the body 22 closer to the beam 16 and consequently to lower a center of gravity of the head monorail car 12. Both the front and the rear load wheels 24, 26 are laterally centered with the body 22, as best shown in FIG. 3, now concurrently referred to. The front load wheel 24 has a spinning axis 36.

The body 22 has a passenger area 32 defined in the empty space surrounded by a shell 34 and the floor 30. To isolate the passenger area 32 from the load wheels 24, 26, a front and a rear wheel covers 44, 46 act as wheel wells and respectively cover the front and the read load wheels 24, 26. These wheel covers 44, 46 are typically made of composite materials capable of withstanding an accidental explosion of a load tire 48.

Figure 4:
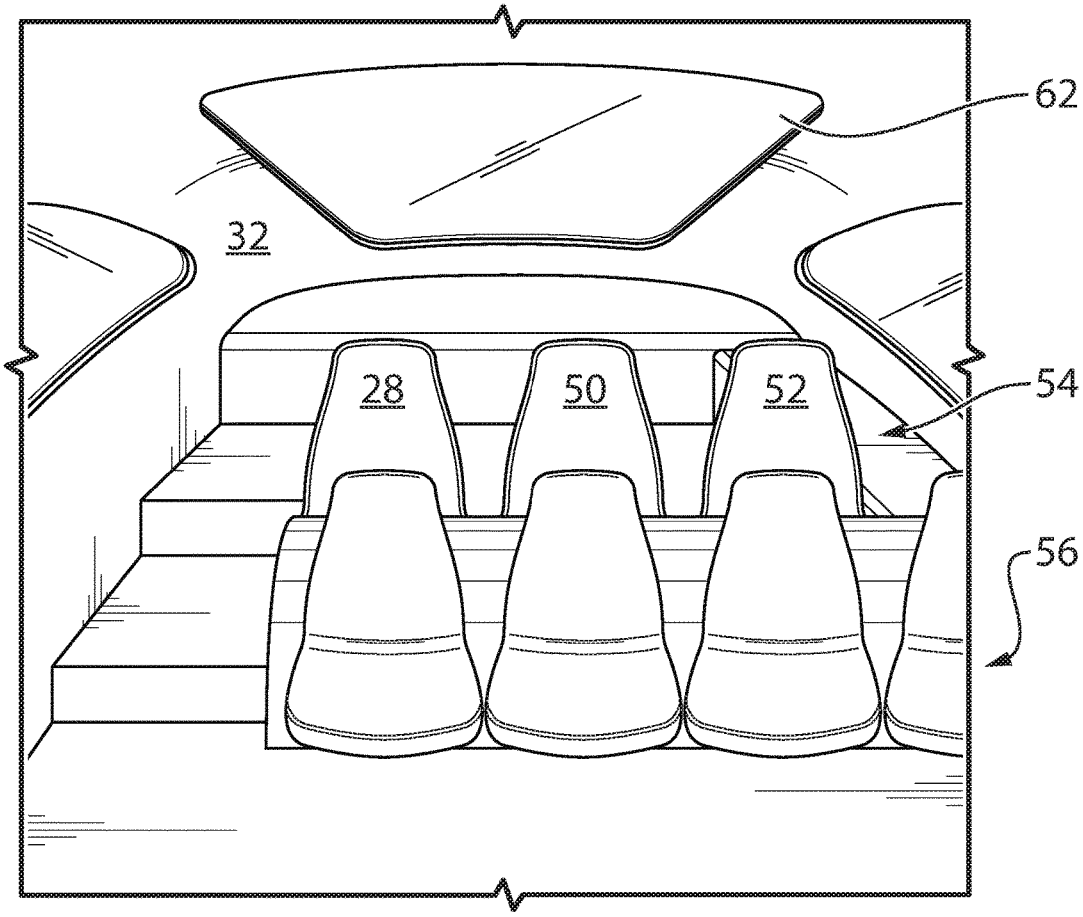
FIG. 4 is a view of an interior of a head monorail car looking towards its front end in accordance with an embodiment of the present invention.

FIG. 4 is now concurrently referred to. At the front end 18, a large windshield 62 provides a rare forward view, this view being usually reserved to a train driver seated in his driver's cab. The windshield 62 may be inclined at different angles. For example, the windshield 62 could be inclined at more than 20 degrees from vertical or even more than 40 degrees from vertical. As shown, the windshield 62 is inclined close to 45 degrees and could even be inclined at a larger angle than 45 degrees. Conveniently, control equipment 38 has been miniaturized and located in a locked compartment on a side of the body 22, providing an uncluttered front portion of the passenger compartment 32

A first seat 28 is installed within the passenger area 32 facing the front end 18 and the windshield 62. The first seat 28 is longitudinally located at least partially between the front end 18 and the spinning axis 36. Optionally, the first seat 28 may be located substantially or even completely between the front end 18 and the spinning axis 36. The first seat 28 is installed at least partially above the front wheel cover 44, conveniently exploiting that space above the front wheel cover 44 that would otherwise be wasted. A second sear 50 and, room permitting, a third seats 52 may also be installed adjacent the first seat 28, making for a first row of seats 54 as best shown in FIG. 4.

To further use the space above the front wheel cover 44, a second row of seats 56 may be installed back to the first row of seats 54 and facing the rear end 20. This second row of seats 56 may be installed at least partially above the front wheel well 44, although typically at a lower level than the first row of seats 56 as the passengers seated in this second row of seats would have their feet rest on a lower floor portion 57 of the floor 30.

Indeed, the seats of the first row of seats 54 are typically placed higher, with respect to the floor 30, than those in the second row of seats 56. This is because mechanical equipment 58 in the front end 18 of the head monorail car 12 takes up space at the floor 30 level and therefore needs to be cleared. Such mechanical equipment 58 may include a crash structure and/or a coupler. Consequently, the head monorail car 12 is typically provided with an upper floor portion 60 that extends horizontally between the front end 18 and the first row of seats 54. This upper floor portion 60 is located at a higher level than that of the lower floor portion 57, making it necessary to install the first row of seats 54 higher than the second row of seats 56.

Both the first row of seats 54 and the second row of seats 56 may be replaced by a wide seat, also known as a bench. In the present description, the term seat shall be interpreted as having any width, thereby being fit to accommodate one person or a plurality of persons. Seat or bench are therefore considered as synonyms in the present description.

A passageway 64 is provided beside the front wheel covers 44 and besides both the first and the second rows of seats 54, 56. As can be seen in FIGS. 3 and 4, the passageway 64 allows connecting the lower floor portion 57 to the upper floor portion 60 with typically one or two steps, or even a ramp.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

What is claimed is:

1. A monorail car having a front end and a read end, said monorail car comprising:

a body, said body having a shell and a floor defining a passenger area there in between, said floor having an upper floor portion and a lower floor portion, said upper floor portion being located at a higher level than that of said lower floor portion;

a front load wheel, said front load wheel being installed proximate said front end and laterally centered with said body, said front load wheel having a spinning axis, said front load wheel at least partially protruding through said floor;

a front wheel cover, said front wheel cover covering said front load wheel;

a rear load wheel, said rear load wheel being installed proximate said rear end and laterally centered with said body;

a first row of seats having at least a first seat, said first seat being installed within said passenger area and facing said front end, said first seat being further installed at least partially between said front end and said spinning axis of said front load wheel, said upper floor portion extending horizontally between said front end and said first row of seats;

a second row of seats, said second row of seats being installed lower than said first row of seats; and a passageway located beside said front wheel cover, said passageway connecting said lower floor portion to said upper floor portion.

2. The monorail car of claim 1 wherein said first seat is installed at least partially above said front wheel cover.

3. The monorail car of claim 2 wherein said first row of seats comprises a second seat adjacent said first seat.

4. The monorail car of claim 3 wherein said first row of seats comprises a third seat adjacent said second seat.

5. The monorail car of claim 2 wherein said second row of seats is installed back to said first row of seats and facing said rear end, said second row of seats being further installed at least partially above said front wheel cover.

6. The monorail car of claim 1 further comprising a windshield at said front end, said windshield being inclined at an angle of more than 20 degrees from vertical.

7. The monorail car of claim 6 wherein said windshield is inclined at an angle of more than 40 degrees from vertical.

8. The monorail car of claim 1 wherein said monorail car is a head monorail car.

* * * * *